United States Patent [19]

Saeki

[11] 4,154,271

[45] May 15, 1979

[54] HAIR SPRAYER

[76] Inventor: Motoharu Saeki, 13-10, 5-Chome, Asakusabashi, Taito-Ku, Tokyo, Japan

[21] Appl. No.: 806,231

[22] Filed: Jun. 13, 1977

[51] Int. Cl.[2] ..... B65B 31/04

[52] U.S. Cl. ..... 141/20; 239/337

[58] Field of Search ..... 141/3, 20; 239/337; 222/402.24

[56] References Cited

U.S. PATENT DOCUMENTS

| | | | |
|---|---|---|---|
| 3,039,659 | 6/1962 | Sagarin | 239/337 X |
| 3,366,148 | 1/1968 | Mizuguchi | 141/20 X |
| 3,368,591 | 2/1968 | Zerbetto | 141/20 |
| 3,718,165 | 2/1973 | Grothoff | 141/20 |

*Primary Examiner*—Robert W. Saifer

*Attorney, Agent, or Firm*—Fred Philpitt

[57] ABSTRACT

A hair sprayer provided with a spray nozzle and a cylindrical body which is partially or entirely transparent or translucent and is capable of accommodating a hair dressing liquid and pressurized air and being provided with an air pressure inlet having a built-in check valve that allows injection of pressure air into the cylindrical body and the cylindrical body being provided with a lid through which the liquid can be supplemented when needed.

2 Claims, 3 Drawing Figures

HAIR SPRAYER

SUMMARY OF INVENTION

The present invention relates to hair sprayers which are capable of replacing a hair dressing liquid in the vessel with another liquid during its use and of adding a liquid to the liquid in the vessel, and also are capable of supplementing pressure air into the vessel by providing a pressure air inlet to the cylindrical body.

In the conventional hair sprayers, in case a hair dressing liquid was once poured, it was impossible to replace the liquid or add it in the middle of its use. Most of the vessels of the conventional hair sprayers were made of metal, and were of opaque and remaining amount in the vessel during the use could not be confirmed from the outside, and therefore in most cases, a user shook the vessel in various directions, for example, vertically and horizontally to guess at the remaining amount by condition of sound and feeling of response, and this method was both unreliable, and inconvenient. Also, when the pressure in the vessel became low, even if there was some liquid remaining, it was difficult to use the solution completely, and the user was compelled to throw it away, which was wasteful. Empty cans generated daily in an enormous volume must be salvaged as promptly as possible both from the standpoints of saving resources and disposing thereof, which are of big problems generally and are getting out of hand.

Also, since the liquid inside of the conventional hair sprayers is gasified and synthesized, depending on type of materials contained therein, there are apprehensions that those materials will have an adverse influence on human bodies.

The present invention has been conceived to eliminate those drawbacks.

An object of the present invention is to provide hair sprayers which are capable of replacing a liquid in the vessel during its use and of adding a liquid thereto.

Other objects and advantages of the invention will become apparent from the following detailed description of an embodiment of the invention when considered together with the attached drawing.

DETAILED DESCRIPTION OF INVENTION

Figure 1:
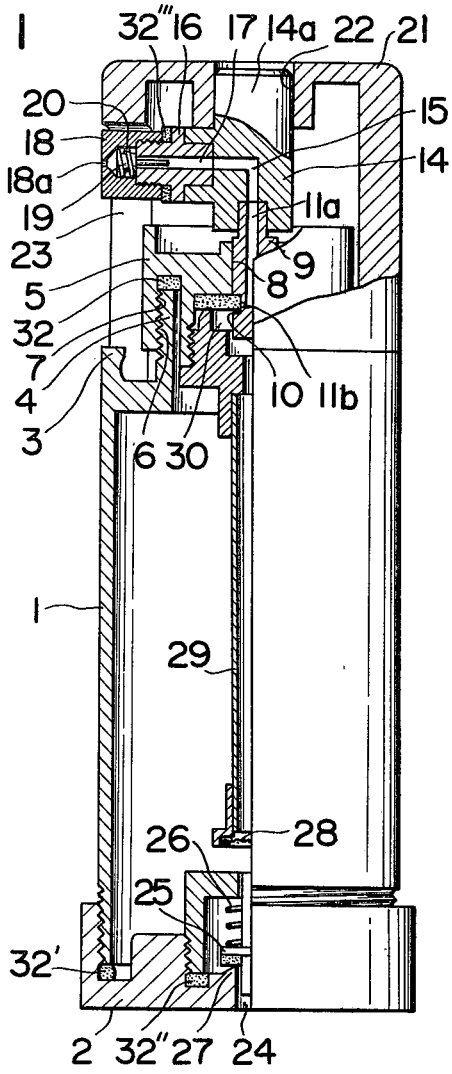
FIG. 1 is a side view of an embodiment of a hair sprayer according to the present invention partially cut away.

FIG. 1 shows a side view of an embodiment of the hair sprayer according to the present invention with a portion cut away.

As shown in the drawing, a bottom end of a transparent or translucent cylindrical body 1 capable of withstanding 7–10 atmospheric pressures is sealed by a bottom cover 2.

At the top portion of the cylindrical body 1, an annular peripheral wall 3 is provided which is slightly lower than a tubular portion 4 which is provided at the inside.

The tubular portion 4 is screwed with a lid 5. For the screwing of the lid 5, a male thread 6 of the outer periphery of the tubular portion 4 and a female thread 7 formed at the lower half portion of the lid 5 are used.

At the center position of the lid, a vertical hole 8 is formed. A movable member 9 which is capable of sliding in the axial direction is fitted into the vertical hole 8.

A movable member 9 is formed with a peripheral groove 10 at the lower part. On this peripheral groove, a hole **11*b* is opened which communicates with a hole 11*a*** opened at the top portion of the movable member.

Figure 2:
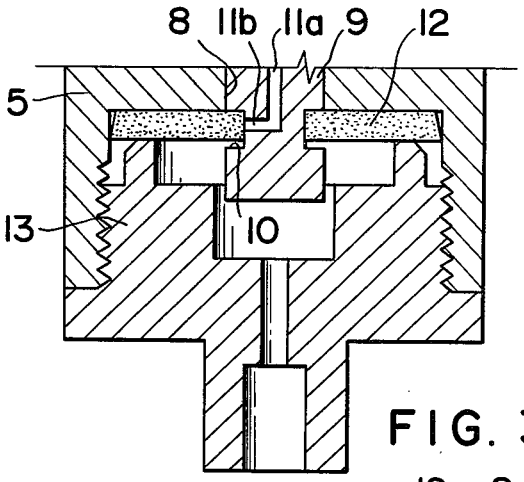
FIG. 2 is an enlarged cross sectional view of the structure of the valve proper.
Figure 3:
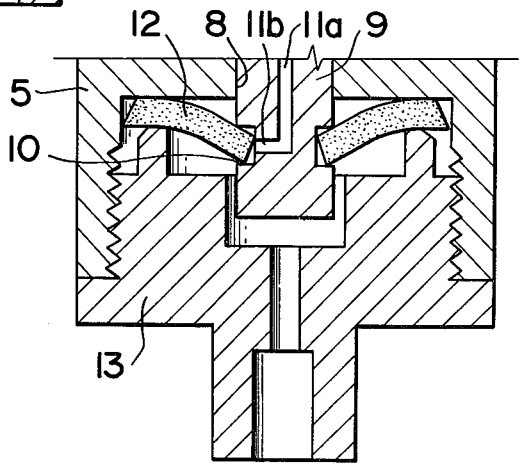
FIG. 3 is an enlarged cross sectional view of a condition where the valve is open.

As shown in FIGS. 2 and 3 in enlarged views, in the peripheral groove 10, a valve body 12 made of rubber and the like which has resiliency is fitted. This valve body 12 has a thickness sufficient to close the hole **11*b* in the inside diametral portion, but the width of the peripheral groove 10 is made slightly larger than the thickness of the valve body 12, so that it can make required relative free movement in the space formed with the peripheral groove 10** in the inside diametral portion.

On the other hand, the valve body 12 is fixed to the lid 5 by a valve holder 13 to be screwed to the lid 5 in the vicinity of the outside diametral portion.

As the valve body 12 has a considerably larger thickness as compared with the outside diameter, when the movable member 9 is compressed as shown in FIG. 3, the hole **11*b* is open by deformation of the valve body 12 due to pressing down of the inside diametral portion, and the resiliency of the valve body 12 lifts the movable member 9 when the external force to the movable member 9 is eliminated and the hole 11*b* is closed again as shown in FIG. 2**.

The external force for pressing down the movable member 9 is given by holding a nozzle holder 14 down which is fitted on the movable member 9.

The nozzle holder 14 is formed with a hole 15 communicating with the hole **11*a*. This hole 15 communicates with a hole 17 of a nozzle head 16 fixed to the front surface of the nozzle holder 14**.

A nozzle cap 18 is screwed to this nozzle head 16 and at the inside of the nozzle cap 18, spindle 20 formed with a spiral groove 19 on its outer periphery is provided. This spindle 20 is useful in applying a revolving property to the liquid when the atomizing action is effected.

A cylindrical upper half portion **14*a* of the nozzle holder 14 is inserted into a guide hole 22 of a safety cap 21 that fits and engages the peripheral wall 3** with its lower end portion.

Although the safety cap 21 guides the vertical movement of the nozzle holder 14, the level of its top portion is higher than that of the top portion of the nozzle holder 14 which prevents the nozzle holder 14 from being pressed down by error.

Also, in order not to disturb the vertical movement of the nozzle holder 14, part of the side wall of the portion to which the nozzle cap 18 is located is vertically cut away to form a guide slit 23 for the nozzle cap 18.

Contents in the cylindrical body 1, for example, hair dressing liquid is poured into the tubular portion 4 from which the lid 5 is detached.

The liquid receives air pressure which has 7–10 atmospheric pressures compressed into the cylindrical body by an air pump (a pump used for bicycle, life loat or air mat) through an air pressure inlet 24 formed on the bottom cover 2.

A check valve 25 is provided on the air pressure inlet 24. This check valve 25 is urged against a valve seat 27 by means of a spring 26, and it is released by the insertion of a nozzle of the air pump (not shown in the drawing).

The liquid in the cylindrical body is lifted in the inner space 30 of the valve holder 13 through a conduit provided with a strainer 28 at its lower end, and when the valve body 12 is deformed due to pressing down of the movable member 9, the liquid is pressure fed from the hole 11*b* which is opened by the deformation through the holes 11*a*, 15 and 17 to the hole 18*a* of the nozzle cap 18.

The bottom cover 2 is screwed and fixed to the cylindrical body 1, and a valve box that holds the check valve 25 is screwed and fixed to the inside of the bottom cover 2.

The cleaning of the inside of the cylindrical body 11 can be accomplished easily by detaching the bottom cover 2.

Packings 32, 32', 32'', and 32''' are provided at the joined portion to effect liquid tightness and air tightness.

This invention has the foregoing construction so that in order to use it, pour a liquid such as hair dressing liquid into the cylindrical body 1 and closes the lid 5 and then put the safety cap 21 on the cylindrical body 1 and the air is compressed into the cylindrical body 1 through the air pressure inlet 24 by using a proper air pump which applies the pressure sufficient to atomize the liquid to the cylindrical body containing the liquid.

When the present invention is to be used, press down the nozzle holder 14 to move the movable member 9 to cause the deformation of the valve body 12, and then the hole 11*b* is opened, and the inside liquid flow into the valve body 12 under the influence of air pressure and is pressure fed toward the nozzle cap 18 through the hole 11*b* and is discharged in mist form.

Also, when the internal pressure of the cylindrical body 1 becomes low, the pressure may be optionally supplemented by the air pump.

Furthermore, as the amount of liquid remaining can be confirmed visually from the outside, a user can use it without anxiety.

As will be obvious from the foregoing description, according to the present invention, this sprayer does not use dangerous liquefied gas, which results in dangerous accidents and also this sprayer can be used repeatedly by supplementing the air pressure and liquid, and confirmination of the amount of the liquid remaining can be made, and therefore it has useful advantages from the standpoint of saving of resources and of avoiding pollution due to discarded materials.

Many modifications may be made by those who desire to practice the invention without departing from the scope thereof which is defined by the appended claims.

What is claimed is:

1. A hair sprayer comprising in combination a cylindrical body 1 for accommodating a hair dressing liquid and pressurized air, a spray nozzle 18 for spraying the liquid, a nozzle holder 14 to press down the nozzle 18, a valve body 12 for allowing the pressure liquid to escape through a movable member 9, a conduit 29 provided with a strainer 28, a lid 5 for housing the valve body 12 and the movable member 9, a protection cap 21 for protecting the nozzle holder 14, and a bottom cover with an air pressure inlet 24 having a built-in check valve 25, whereby the hair dressing liquid can be supplemented by removing the protection cap 21 and the lid 5 during its use and also the pressure air can be supplemented through the air pressure inlet by using an air pump during its use and the remaining amount of the liquid can be confirmed through the at least partially transparent or at least partially translucent side wall of the cylindrical body 1.

2. A hair sprayer as claimed in claim 1 wherein the cylindrical body 1 is capable of withstanding 7–10 atmospheric pressure.

* * * * *